US009702351B2

(12) United States Patent
Steinhour

(10) Patent No.: US 9,702,351 B2
(45) Date of Patent: Jul. 11, 2017

(54) CONVECTION PUMP AND METHOD OF OPERATION

(71) Applicant: Leif Alexi Steinhour, Berkeley, CA (US)

(72) Inventor: Leif Alexi Steinhour, Berkeley, CA (US)

( * ) Notice: Subject to any disclaimer, the term of this patent is extended or adjusted under 35 U.S.C. 154(b) by 323 days.

(21) Appl. No.: 14/121,997

(22) Filed: Nov. 12, 2014

(65) Prior Publication Data

US 2016/0131122 A1 May 12, 2016

(51) Int. Cl.
*F04B 19/24* (2006.01)
*F04B 53/08* (2006.01)

(52) U.S. Cl.
CPC ..... *F04B 19/24* (2013.01); *F04B 53/08* (2013.01)

(58) Field of Classification Search
CPC ... F04B 53/08; F04B 19/24; F28F 1/26; F28F 13/12; F28F 13/125
USPC .... 165/58–66, 109.1, 181; 417/53, 407, 207
See application file for complete search history.

(56) References Cited

U.S. PATENT DOCUMENTS 1,335,506 A * 3/1920 Jones ..... F28D 7/1669 165/161
1,459,024 A * 6/1923 Hartburg ..... F28F 13/12 138/38
2,137,868 A * 11/1938 Wilson ..... C21D 9/663 126/91 A
2,465,685 A * 3/1949 Henderson ..... A61M 1/0066 219/201
2,955,807 A * 10/1960 Coates ..... B01D 7/02 165/110
3,177,936 A * 4/1965 Gustave ..... F28F 1/06 138/40
3,232,073 A * 2/1966 Jobes ..... F25B 13/00 62/160
3,235,003 A * 2/1966 Smith ..... F01N 1/125 138/38
3,423,294 A * 1/1969 Sephton ..... B01D 1/10 159/13.2
3,457,982 A * 7/1969 Sephton ..... B01D 1/10 138/38
3,571,940 A * 3/1971 Bender ..... F26B 5/06 220/592.01
3,648,754 A * 3/1972 Sephton ..... B01D 63/06 138/38

(Continued)

FOREIGN PATENT DOCUMENTS

DE 4220077 A1 * 12/1993 ..... F04B 19/006
DE 202004006074 U1 * 10/2004 ..... F04B 17/00

(Continued)

*Primary Examiner* — Devon Kramer
*Assistant Examiner* — Benjamin Doyle

(57) ABSTRACT

This disclosure provides systems, methods, and apparatus related to a convection pump. In one aspect, an apparatus includes a chamber, the chamber having an inlet at a first end of the chamber and an outlet at a second end of the chamber. The chamber further has a first surface and a second surface, the first surface being opposite to the second surface. A baffle having a substantially helical shape is disposed inside the chamber. A heating device is configured to heat the first surface of the chamber. A cooling device is configured to cool the second surface of the chamber.

19 Claims, 5 Drawing Sheets

(56) References Cited

U.S. PATENT DOCUMENTS 3,846,254 A * 11/1974 Sephton ..... B01D 1/04 159/13.2
3,958,253 A * 5/1976 Rueckmann ..... G11B 7/241 346/135.1
4,253,801 A * 3/1981 O'Hare ..... F24D 11/007 126/569
4,416,587 A * 11/1983 Trihey ..... F04B 19/24 417/209
4,502,531 A * 3/1985 Petersen ..... C21D 9/0068 165/136
4,671,212 A * 6/1987 Smith ..... F24H 1/41 122/155.2
4,740,495 A * 4/1988 Marinelli ..... B41M 5/42 106/31.18
5,871,336 A * 2/1999 Young ..... F04B 37/06 417/207
6,123,512 A * 9/2000 Benner ..... F04B 17/00 417/209
7,661,460 B1 * 2/2010 Cowans ..... F28D 7/024 165/140
7,836,942 B2 * 11/2010 Cannas ..... F24H 1/43 165/163
7,980,828 B1 * 7/2011 Lantz ..... F04B 19/006 417/207
8,104,532 B2 * 1/2012 Cardone ..... F28D 1/035 165/48.1
8,517,008 B2 * 8/2013 Plotkin ..... F24J 2/07 126/651
2002/0050342 A1 * 5/2002 Gerstmann ..... F22B 7/00 165/109.1
2004/0244356 A1 * 12/2004 Ronney ..... F02K 9/95 60/200.1
2005/0056408 A1 * 3/2005 Gregory ..... F28D 1/053 165/151
2005/0095143 A1 * 5/2005 Bernard ..... F04B 19/24 417/207
2006/0078434 A1 * 4/2006 Kim ..... F04B 19/24 417/51
2008/0159877 A1 * 7/2008 Sugimoto ..... F04B 19/006 417/51
2009/0175736 A1 * 7/2009 Gianchandani ..... F04B 19/006 417/207
2010/0046934 A1 * 2/2010 Johnson ..... F24H 1/121 392/480
2011/0277494 A1 * 11/2011 Kikuno ..... F24D 17/02 62/324.1
2012/0145362 A1 * 6/2012 Harrington ..... H01L 23/473 165/109.1
2012/0157969 A1 * 6/2012 Martin ..... A61M 25/06 604/523
2012/0207625 A1 * 8/2012 McNamara ..... F04B 19/24 417/207
2013/0183717 A1 * 7/2013 Marble ..... B01L 3/502784 435/91.2
2014/0007569 A1 * 1/2014 Gayton ..... F02G 1/055 60/508
2014/0037468 A1 * 2/2014 Kloss ..... F04B 19/24 417/207
2014/0127365 A1 * 5/2014 Batmaz ..... A23L 3/22 426/231
2015/0027319 A1 * 1/2015 Wu ..... A47J 27/10 99/330
2015/0235719 A1 * 8/2015 Caddell ..... G21C 15/257 376/361
2016/0216045 A1 * 7/2016 Chan ..... F28F 13/12

FOREIGN PATENT DOCUMENTS

DE 10332315 A1 * 2/2005 ..... F04B 19/006
GB 430015 A * 6/1935 ..... F28F 1/405
GB 1503899 A * 3/1978 ..... F28F 13/12
WO WO 2011050285 A1 * 4/2011 ..... F04B 19/24

* cited by examiner

CONVECTION PUMP AND METHOD OF OPERATION

STATEMENT OF GOVERNMENT SUPPORT

This invention was made with government support under Contract No. DE-AC02-05CH11231 awarded by the U.S. Department of Energy. The government has certain rights in this invention.

RELATED APPLICATIONS

Not applicable.

TECHNICAL FIELD

This disclosure relates generally to apparatus and methods for pumping gases, and more particularly apparatus and methods for pumping gases using a thermal gradient.

BACKGROUND

A pump is a device that can move a fluid (i.e., a liquid or a gas). For example, a pump can transport a fluid from one location to another location. Most pumps operate by a mechanical action.

SUMMARY

In some embodiments, a convection pump may include a pipe, a substantially helical or screw-shaped baffle disposed or mounted inside of the pipe, a device to heat one side of the pipe, and a device to cool the opposite side of the pipe.

One innovative aspect of the subject matter described in this disclosure can be implemented by an apparatus including a chamber having an inlet at a first end of the chamber and an outlet at a second end of the chamber. The chamber further includes a first surface and a second surface, the first surface being opposite to the second surface. A baffle having a substantially helical shape is disposed inside the chamber. A heating device is configured to heat the first surface of the chamber. A cooling device is configured to cool the second surface of the chamber.

In some embodiments, the chamber is a pipe. In some embodiments, the chamber is a pipe having a cylindrical shape. In some embodiments, the chamber is a pipe having a substantially circular cross-section. In some embodiments, the chamber has a non-cylindrical cross section, such as square, rectangular, or hexagonal. In some embodiments, the chamber has an oval cross section. In some embodiments, the chamber is fabricated from a material selected from the group consisting of a metal, a ceramic, a composite, a glass, a polymer (e.g., a plastic), and concrete.

In some embodiments, the heating device includes a dark-colored surface in thermal contact with the first surface. In some embodiments, the cooling device is selected from the group consisting of a radiative cooling device, a convective cooling device, a heat pump, and a thermal reservoir.

In some embodiments, the first surface is substantially parallel to a vertical direction, and the second surface is substantially parallel to the vertical direction. In some embodiments, an axis or a central chord of the chamber lies along a substantially straight line. In some embodiments, an axis of or a central chord of the chamber has a coiled configuration. In some embodiments, the chamber is arranged in a coiled configuration.

In some embodiments, the apparatus further includes an insulating material separating the first surface and the second surface. In some embodiments, the insulating material includes a rubber material or a plastic material. In some embodiments, the insulating material includes a rubber gasket or a plastic gasket. In some embodiments, the first surface and the second surface are configured to be separable from one another.

In some embodiments, a cross section of the chamber decreases from the inlet of the chamber to the outlet of the chamber.

Another innovative aspect of the subject matter described in this disclosure can be implemented by a method which uses an apparatus as described herein. The apparatus includes a chamber, the chamber having an inlet at a first end of the chamber and an outlet at a second end of the chamber. The chamber further has a first surface and a second surface, the first surface being opposite to the second surface. A baffle having a substantially helical shape is disposed inside the chamber. A heating device is configured to heat the first surface of the chamber. A cooling device is configured to cool the second surface of the chamber. The first surface is heated and the second surface is cooled. Heating the first surface and cooling the second surface transports a gas from the first end of the chamber to a second end of the chamber.

In some embodiments, the first surface and the second surface are disposed along a substantially horizontal plane.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

DETAILED DESCRIPTION

Introduction

Figure 1:
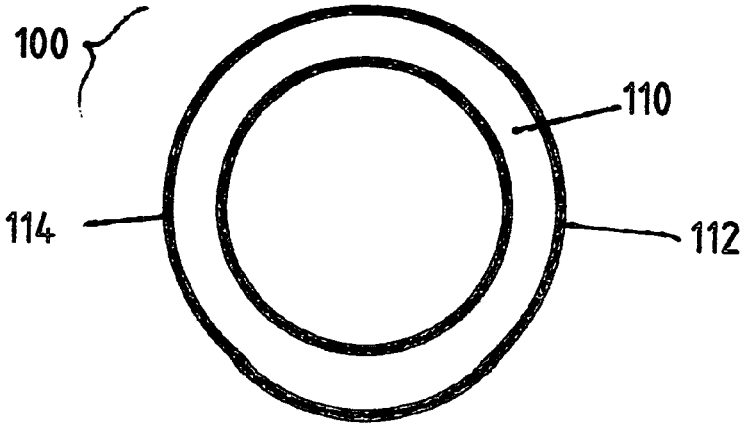
FIGS. 1-3 show example of schematic illustration of a convection pump.

As noted in the BACKGROUND section, most pumps operate by mechanical action. For example, some pumps use mechanical action to change the volume of a chamber to pump a fluid. That is, pumping action is achieved using a variable volume.

Disclosed herein is a pump (i.e., a convection pump) that produces a pumping action without changing the dimensions of a chamber. In some embodiments, the convection pump has no moving parts. In some embodiments, the convection pump may be able to pump a gas. In some embodiments, the convection pump also may be able to compress a gas. In some embodiments, the energy input to the convection pump to pump the gas is heat. For example, in some embodiments, the convection pump may be used to move air horizontally from one location to another location.

Reference will now be made in detail to some specific examples of the invention including the best modes contemplated by the inventors for carrying out the invention.

Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise.

Apparatus

Embodiments disclosed herein relate to apparatus and methods of pumping gases. In some embodiments, a convection pump includes a chamber or an enclosure that is disposed in a substantially horizontal plane. In some embodiments, the chamber has a cylindrical or a substantially cylindrical shape (e.g., a pipe, tube, or hose). The chamber includes an inlet at one end of the chamber and an outlet at the other end of the chamber. A helical baffle is disposed in the chamber along the axis of the chamber.

In operation, a thermal gradient between two sides of the chamber is created, with the two sides being substantially perpendicular from the substantially horizontal plane. The two sides are also substantially opposite one another; for example, the two sides may be located on the two ends of a diameter through a cross-section of a cylindrical chamber, along a substantially horizontal direction. The gas being pumped by the convection pump flows into the cylindrical chamber through the inlet and out of the chamber through the outlet. During operation, the gas being pumped by the convection pump is heated and cooled, which causes the gas to rise and fall, transporting the gas from the inlet of the convection pump the outlet of the convection pump.

In some embodiments, the inlet of the convection pump is located such that gas flowing into the chamber first encounters the heated or cooled side having the largest difference from the temperature of the gas. For example, a thermal gradient between two sides of the chamber may be established by heating one side using solar energy and cooling one side using fins (i.e., extended surfaces that increase the rate of heat transfer to the environment by increasing convection) at room temperature. When the gas flowing into such a convention pump is at room temperature, the inlet may be positioned such that the gas first encounters the heated, side. The heated surface will heat the gas and cause some of the gas in the chamber to rise. The helical baffle will force some of the gas horizontally as it rises. The gas passes over the axis of the baffle and contacts the cooled surface. The gas will cool, which will cause it to descend. The baffle translates this tendency of the gas (i.e., rising due to the hot surface and descending due to the cool surface) into further horizontal motion in the same direction.

Figure 2:
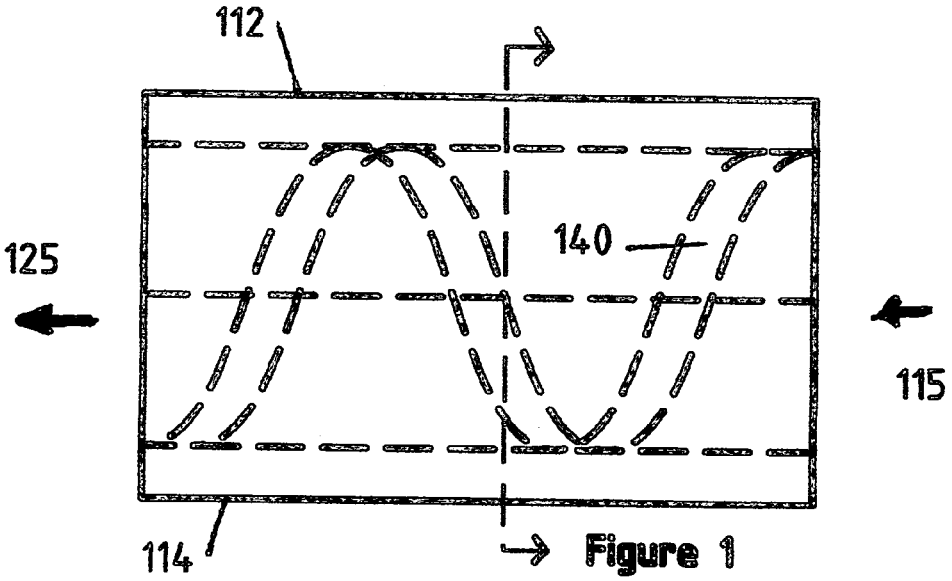
Figure 3:
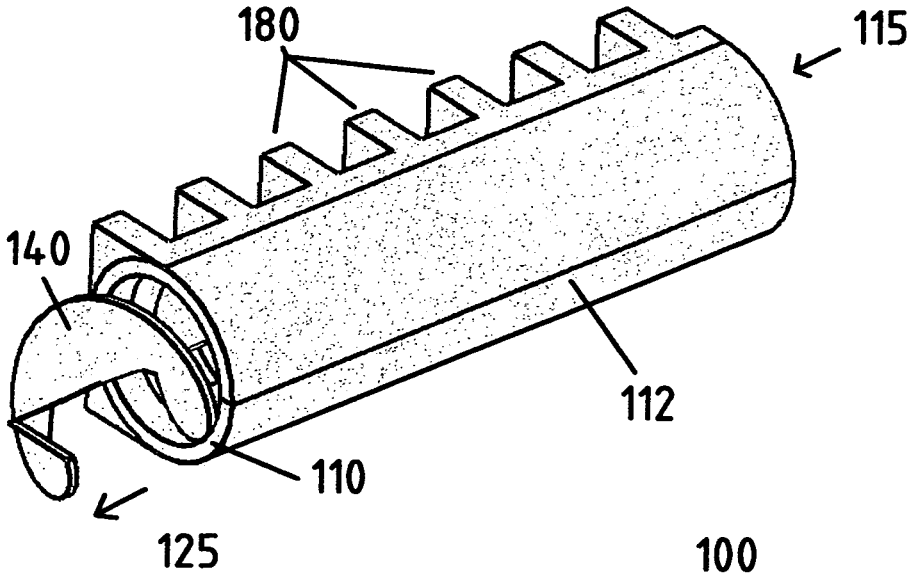

FIGS. 1-3 show examples of schematic illustrations of a convection pump. FIG. 2 shows a cross-sectional schematic illustration of a top-down view of a convection pump. FIG. 1 shows a cross-sectional schematic illustration of the convection pump though line 1-1 of FIG. 2. FIG. 3 shows an isometric view of a convection pump.

As shown in FIGS. 1-3, a convection pump 100 includes a chamber 110 having an inlet 115 and an outlet 125. A helical baffle 140 (not shown in FIG. 1) is disposed within chamber 110. The convection pump 100 includes a wall 112 that is heated when the pump is in operation. The convection pump 100 further includes a wall 114 that is cooled when the pump is in operation.

In operation of the convection pump 100, gas flows into the chamber 110 through the inlet 115 and out of the chamber 110 through outlet 125. The gas is heated by the wall 112, causing it to rise. The baffle 140 causes the gas to translate in the direction of the outlet 125 as it rises, and the gas will rise so that it is over the baffle 140 in the process. The momentum of the gas will then carry it over the baffle 140, so that it comes in contact with the wall 114. The wall 114 will cool the gas, and the reduction in the gas density due to the cooling will cause the gas to fall. The baffle will then cause the gas to translate again in the direction of the outlet 125, whereby the process will repeat itself until the gas reaches the outlet 125 and leaves the chamber 110.

In some embodiments, when the gas includes particulate matter, the particulate matter may move under the mechanism of thermophoresis from the hot wall 112 to the cold wall 114, causing the matter to become deposited on the colder side. Thus, the gas may also be filtered as it is being transported by the convection pump 100 from the inlet 115 to the outlet 125.

In some embodiments, the chamber 110 is a cylinder (i.e., a chamber having a circular cross section) or a pipe. Other chamber shapes are possible. For example, in some embodiments, a cross section of the chamber 110 may be square, rectangular, or hexagonal. In some embodiments, a cross section of the chamber 110 may be an ellipse, with the major axis of the ellipse being oriented in a vertical direction. In some embodiments, the chamber 110 may have an oval-shaped cross section. In some embodiments, when the chamber does not have a circular cross section, there may be greater heat transfer between the heated surface and cooled surface (in some applications).

The chamber 110 may be of any length needed to accomplish the desired gas pumping. In some embodiments, a pump may be made by connecting a plurality of the chambers 110 together in a modular fashion. For example, the outlet 125 of one chamber 110 could be attached to the inlet 115 of another chamber 110. This may allow for making a pump of a desired length, with one size of the chamber 110 being manufactured. In some embodiments, the chamber 110 may be made from any readily-obtained structure for fluid conveyance, such as a pipe (e.g., having a cylindrical or a non-cylindrical in cross section), a tube, a hose, or a channel. In some embodiments, the chamber 110 may also be tapered along the direction of the intended flow of gas. For example, when the chamber 110 has a circular cross section, the diameter of the circle may decrease from the inlet 115 to the outlet 125. A chamber with a tapering cross section would allow for a tailoring of the exit pressure and flow relative to the inlet pressure and flow. In some embodiments, the axis of the chamber 110 may not be a straight line. For example, the chamber 110 may be bent do follow a desired contour.

The chamber 110 may be constructed of any material capable of being formed into the desired shape. For example, in some embodiments, the chamber 110 may be formed from a metal, a polymer (e.g., a plastic), a ceramic, a glass, or concrete. In some embodiments, the chamber may be fabricated to reduce the thermal conductivity between the wall 112 and the wall 114. For example, in some embodiments, the chamber 110 may be formed from a thin material or material which thins as it approaches the axis or chord of the chamber; this may enable good heat transfer from the walls 112 and 114 and reduce the parasitic heat conduction from the wall 112 to the wall 114 through the baffle.

As another example, in some embodiments, the wall 112 and the wall 114 may be formed from a conducting material and an insulating material may be disposed between the wall 112 and the wall 114. This may be done, for example, by splitting a tube along a diameter, and then joining the two halves of the tube with an insulating material. In some embodiments, the connection between the two halves of the tube is air-tight; i.e., the connection does not allow for gas flow between the two halves. Further, in such a configuration, the walls 112 and 114 of the convection pump 100 may be separable. For example, the walls 112 and 114 could be separated for cleaning the convection pump 100. In some embodiments, the walls 112 and 114 may be connected with many different techniques and devices, including removable devices, such as screws or quick release fasteners. Such an embodiment is shown in FIG. 4.

Figure 4:
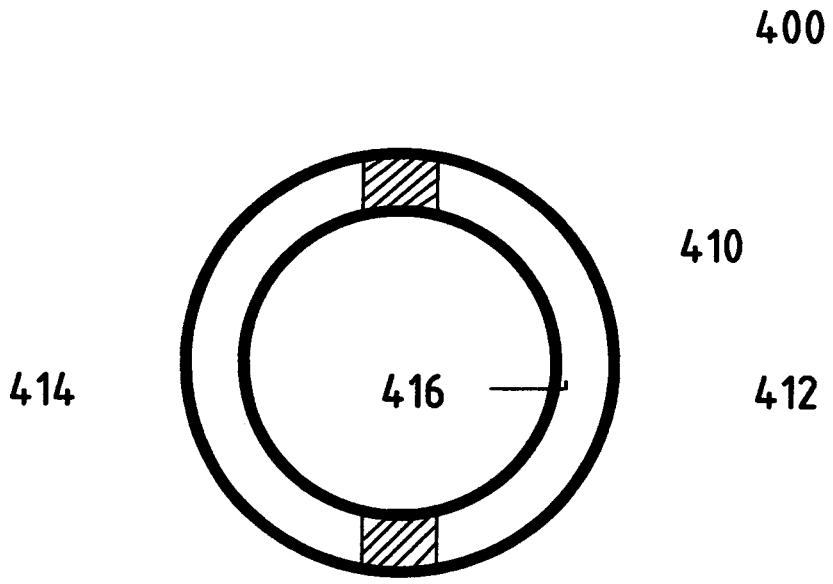
FIG. 4 shows an example of a cross-sectional schematic illustration of a convection pump.

FIG. 4 shows an example of a cross-sectional schematic illustration of a convection pump 400. The convection pump 400 shown in FIG. 4 may be similar to the convection pump 100 shown in FIGS. 1-3 with the addition of an insulating material separating the two sides of the convection pump. The convection pump 400 includes a chamber 410. The convection pump 400 includes a wall 412 that is heated and a wall 414 that is cooled when the pump 400 is in operation. Separating the walls 412 and 414 is an insulating material 416. In some embodiments, the insulating material includes a polymer (e.g., a plastic or a rubber), a glass, or a ceramic.

In some embodiments, the convection pump 100 includes the helical baffle 140. The helical baffle 140 is a structure shaped as a helix or a screw. In some embodiments, the edge (e.g., made of the spiral shaped vane arranged around a solid axis) of the helical baffle 140 is sealed to the inside wall of the chamber 110 so that a gas cannot pass between the edge and the inside of the chamber 110. The helical baffle 140 may be constructed of any material. For example, in some embodiments, the helical baffle 140 may be formed from a metal, a polymer (e.g., a plastic), a ceramic, a glass, or concrete. In some embodiments, the helical baffle 140 may be formed to increase heat transfer to the gas from the heated wall 112 and the cooled wall 114 but to reduce conductive heat transfer from heated wall 112 to the cooled wall 114. For example, in some embodiments, the edge of the spiral shaped vane arranged around the axis of the helical baffle 140 may be thicker where it contacts the inside wall of the chamber 110 and thinner closer to the axis of the helical baffle 140. In some embodiments, the helical baffle 140 may be able to be removed from the chamber 110 so that it can be cleaned, for example.

The wall 112 may be heated with a number of different energy sources. For example, in some embodiments, the wall 112 may include a resistively heated device disposed on the wall that may be heated with electricity. In some embodiments, the wall 112 may be heated with solar energy. For example, in some embodiments, the wall 112 may be a dark color so that surface of the wall may absorb solar energy.

When the wall 112 is heated with solar energy, in some embodiments a dark-colored surface may be disposed on the interior of the chamber 110 proximate the wall 112. The wall 112 may be a clear material that allows for the transmission of solar energy, with the colored surface heating up so that the convection pump 100 operates.

The wall 114 may be cooled by a number of different mechanisms. In some embodiments, the wall 114 may include a plurality of fins (shown as 180 in FIG. 3) extending from the wall which may allow for heat dissipation to the environment; such a cooling mechanism may be used when the wall 112 is heated above room temperature. In some embodiments, the wall 114 may be in thermal contact with the cold side of a heat pump or reservoir; such a cooling mechanism may be used when the wall 112 is in contract with a thermal reservoir at room temperature.

While not intending to be limiting, it is believed that the operation of the convection pump relies upon the ideal gas law, such that any compressible fluid which substantially follows the ideal gas law can be pumped by it. The performance of the convection pump depends upon density differences between a hot gas and a cold gas, and will improve with increases in the gas pressure, with increases in the temperature difference between the hot side and the cold side, and with increases in the size of the pump (e.g., both increasing the cross sectional dimensions of the pump and increasing the length of the pump).

The convection pump 100 could be implemented wherever there is a surface (e.g., a flat surface) that is heated or cooled relative to the ambient temperature. Such surfaces may exist in industry, and the convection pump could be used to pump a gas related to the industrial process producing the heating or cooling. For example, one or more convection pumps 100 could be arranged on such a surface. When a surface includes more than one convection pump 100, each pump could operate independently of the other pumps. Alternatively, the plurality of convection pumps 100 could be arranged from top to bottom in series (e.g., the outlet 125 of one convection pump 100 connected to the inlet 115 of another convection pump 100, with the convection pumps having alternating pumping directions due to the alternating chirality of the helical baffles 140 in the convection pump 100). For example, a top pump may have a right-handed helical baffle, the next lower pump may have a left-handed helical baffle, and the next lower pump may have a right-handed helical baffle, and so on.

Figure 5:
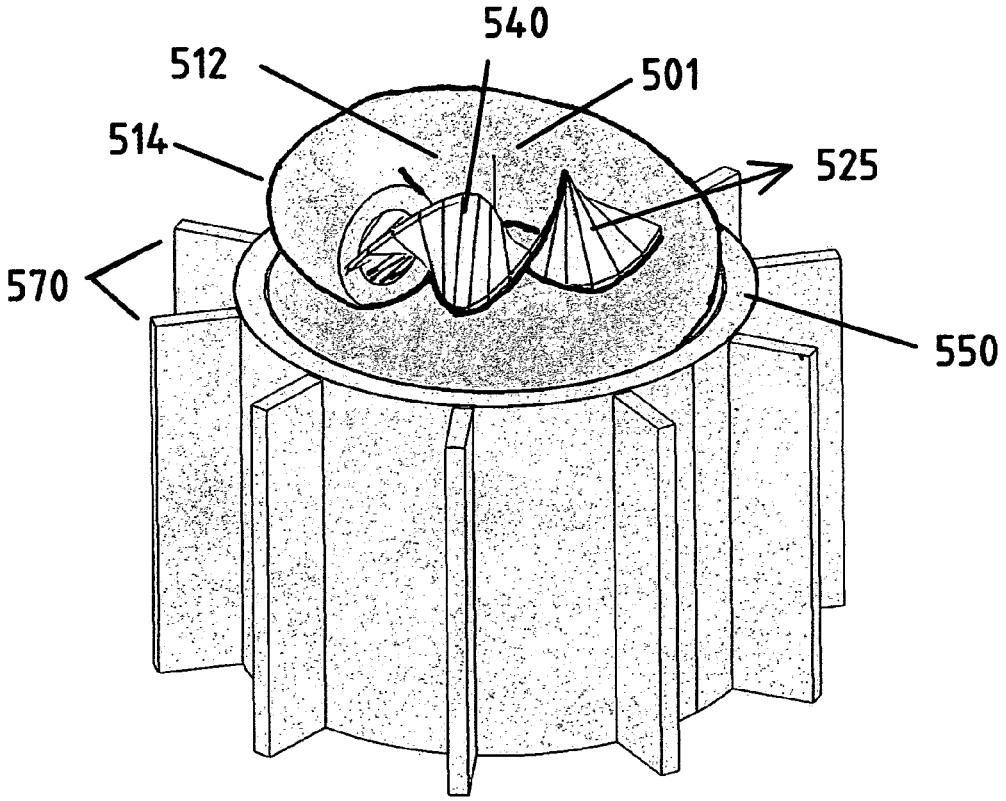
FIG. 5 shows an example of a schematic illustration of a convection pump.

FIG. 5 shows an example of a schematic illustration of a convection pump. The convection pump 500 shown in FIG. 5 may be similar to the convection pump 100 shown in FIGS. 1-3, with the chamber 510 of the convection pump 500 arranged in a spiral manner or coiled about an axis 501. In some embodiments, on the exterior of the coil-shaped chamber 510, a plurality of fins 570 may be disposed to cool the exterior (e.g., the outer circumference) of the coil-shaped chamber. In some embodiments, the coil-shaped chamber 510 may be disposed inside of a pipe 550, with the pipe having a plurality of fins on its exterior surface for cooling. In some embodiments, a heat source may be disposed on the interior of the coil-shaped chamber 510. For example, the heat source could be an airstream carrying waste heat from an industrial process. Alternatively, the convection pump 500 could be disposed about a tube or column carrying a hot fluid created in an industrial process. Thus, a thermal gradient could be established between the outer circumference (in thermal communication with the pipe 550) and the inner circumference of the coil-shaped chamber 510. With such a convection pump 500, gas may enter though inlet (not shown) and be pumped to an outlet 525.

In some embodiments, the chirality (e.g., right handedness or left handedness) of the helical baffle 540 within the coil-shaped chamber 510 could be specified so that a gas is pumped from the bottom of the chamber to the top. That is, the chirality of the helical baffle will determine in-part the direction that gas is pumped; which surface is heated and which is cooled will also determine the direction that the gas is pumped.

Method

The concept of operation of a convection pump is that gas or vapor on the heated side of the pump is at substantially the same pressure as that on the cooled side of the pump, at least from one segment to the next; the segments are defined by the helical baffle. Because the temperature is different on each side of the pump, the density of the gas on the hot side will be less than the density of the gas on the cold side. Gravity will pull the gas on the cold side down, and this will cause gas on the hot side to rise. The helical baffle then converts this rise or fall of gas into pressure and/or motion along the pump axis. The direction of gas motion along the pump axis is determined by the handedness of the helical baffle; i.e., whether the helical baffle is a right handed helix or a left handed helix). This process is independent of the pressure in the gas, making the pump capable of compressing gas.

For example, gas may enter the inlet of a convection pump and encounter a hot surface. The hot surface heats the gas, which then rises. A baffle routes the rising gas axially towards an outlet of the pump as it rises, with the momentum of the gas carrying it over the axis of the baffle. The gas then encounters a cool surface. The cools surface cools the gas, which then falls or sinks. The baffle routes the rising gas axially towards the outlet of the pump as it falls, with the momentum of the gas carrying it under the axis of the baffle. The gas then encounters the hot surface again.

This process is repeated until the gas reaches the outlet, the number of times the process is repeated depending on the number of turns of the baffle. Further, depending on the geometry of the baffle, the gas at the outlet may be a higher pressure or a lower pressure than the pressure of the gas at the inlet. In cases where the outlet is of a larger cross-sectional dimension (e.g., diameter) than the inlet, the outlet pressure may be reduced. In cases where the outlet is of a smaller cross-sectional dimension (e.g., diameter) than the inlet, the outlet pressure may be increased.

Figure 6:
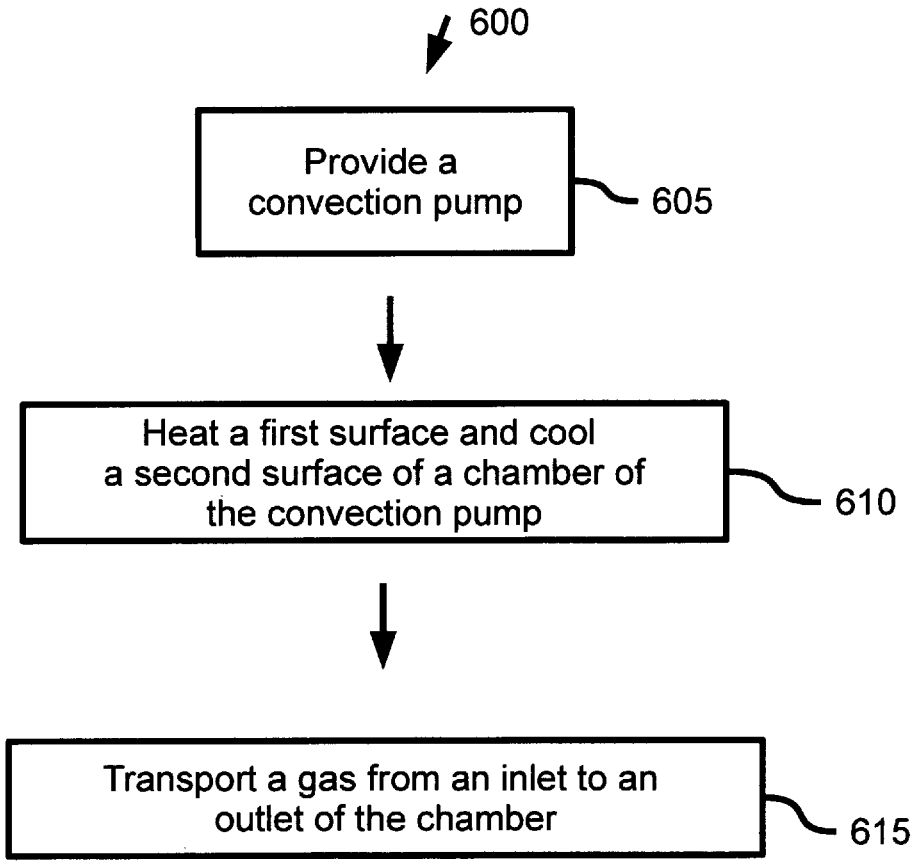
FIG. 6 shows an example of a flow diagram illustrating a method of operation of a convection pump.

FIG. 6 shows an example of a flow diagram illustrating a method of operation of a convection pump. At block 605 of the method 600, a convection pump is provided. The convection pump may include any of the embodiments of convection pumps disclosed here. At block 610, a first surface of a chamber of the convection pump is heated and a second surface of the chamber is cooled. At block 615, a gas is transported from the inlet to the outlet of the chamber.

Conclusion

There are many different applications, including industrial applications, of embodiments of the convection pump disclosed herein. For example, embodiments of the pump may be used to pump a gas, to heat a building, or for air exchange in a building. Embodiments of pump may be used to compress air (i.e., a thermal gradient driven air compressor). In some embodiments, the compressed air may be used to cool a building or a chamber, as compressed air can be used to pump heat (i.e., to transfer heat energy from a heat source to a heat sink against a temperature gradient). In some embodiments, the pump may be used as a solar thruster for an airship or spacecraft.

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

What is claimed is:

1. An apparatus comprising: a chamber containing a fluid, the chamber having an inlet at a first end of the chamber and an outlet at a second end of the chamber, the chamber having a first interior surface and a second interior surface, the first interior surface having a temperature higher than the second interior surface; a baffle having a substantially helical shape disposed inside the chamber; a heating device configured to heat the first interior surface of the chamber, and a cooling device configured to cool the second interior surface of the chamber.

2. The apparatus of claim 1, wherein the chamber is a pipe.

3. The apparatus of claim 1, wherein the chamber is a pipe having a substantially circular cross section.

4. The apparatus of claim 1, wherein the chamber is fabricated from a material selected from the group consisting of a metal, a ceramic, a composite, a glass, a polymer, and concrete.

5. The apparatus of claim 1, wherein the heating device includes a dark-colored surface in thermal contact with the first surface.

6. The apparatus of claim 1, wherein the cooling device is selected from the group consisting of a radiative cooling device, a convective cooling device, a heat pump, and a thermal reservoir.

7. The apparatus of claim 1, wherein the first surface is substantially parallel to a vertical direction, and wherein the second surface is substantially parallel to the vertical direction.

8. The apparatus of claim 1, wherein a central chord of the chamber lies along a substantially straight line.

9. The apparatus of claim 1, wherein the chamber has an oval cross section.

10. The apparatus of claim 1, wherein the chamber is arranged in a coiled configuration.

11. The apparatus of claim 1, further comprising: an insulating material separating the first surface and the second surface.

12. The apparatus of claim 11, wherein the first surface and the second surface are configured to be separable from one another.

13. The apparatus of claim 1, wherein a cross section of the chamber decreases from the inlet of the chamber to the outlet of the chamber.

14. An apparatus according to claim 1, wherein the heating device is disposed on the exterior of the chamber.

15. An apparatus according to claim 1, wherein the apparatus is a pump.

16. An apparatus according to claim 1, wherein the cooling device is disposed on the exterior of the chamber.

17. The apparatus of claim 1, wherein the heating device is disposed on the interior of the chamber.

18. A method comprising: providing an apparatus including: a chamber, the chamber having an inlet at a first end of the chamber and an outlet at a second end of the chamber, the chamber having a first surface and a second surface, the first surface being opposite to the second surface; a baffle having a substantially helical shape disposed inside the chamber; a heating device configured to heat the first surface of the chamber; and a cooling device configured to cool the second surface of the chamber; heating the first surface and cooling the second surface, wherein heating the first surface and cooling the second surface transports a gas from the inlet to the outlet.

19. The method of claim 14, wherein the first surface and the second surface are disposed along a substantially horizontal plane.

* * * * *